US011470692B2

(12) United States Patent
Mellor et al.

(10) Patent No.: US 11,470,692 B2
(45) Date of Patent: Oct. 11, 2022

(54) VEHICLE GLAZING

(71) Applicant: Pilkington Group Limited, Lancashire (GB)

(72) Inventors: Leigh Francis Mellor, St Helens (GB); Joseph Jeremy Boote, Lancashire (GB)

(73) Assignee: PILKINGTON GROUP LIMITED, Lancashire (GB)

( * ) Notice: Subject to any disclaimer, the term of this patent is extended or adjusted under 35 U.S.C. 154(b) by 467 days.

(21) Appl. No.: 16/342,325

(22) PCT Filed: Oct. 16, 2017

(86) PCT No.: PCT/GB2017/053123
§ 371 (c)(1),
(2) Date: Apr. 16, 2019

(87) PCT Pub. No.: WO2018/073567
PCT Pub. Date: Apr. 26, 2018

(65) Prior Publication Data

US 2019/0261463 A1 Aug. 22, 2019

(30) Foreign Application Priority Data

Oct. 17, 2016 (GB) ..... 1617577

(51) Int. Cl.
*H05B 3/84* (2006.01)
*H05B 3/14* (2006.01)

(52) U.S. Cl.
CPC ..... *H05B 3/84* (2013.01); *H05B 3/141* (2013.01); *H05B 2203/011* (2013.01); *H05B 2203/017* (2013.01)

(58) Field of Classification Search
CPC .... H05B 3/84; H05B 3/141; H05B 2203/011; H05B 2203/017; H05B 3/34; H05B 3/22;
(Continued)

(56) References Cited

U.S. PATENT DOCUMENTS 3,931,496 A 1/1976 Hurko
4,443,691 A 4/1984 Sauer
(Continued)

FOREIGN PATENT DOCUMENTS

CN 201895553 U 7/2011
DE 3843626 A1 6/1990
(Continued)

OTHER PUBLICATIONS

United Kingdom Search Report (Patents Act 1977: Search Report under Section 17) dated Mar. 30, 2017, issued by the United Kingdom Patent Office in the corresponding United Kingdom Patent Application No. GB1617577.0.
(Continued)

*Primary Examiner* — Shawntina T Fuqua
(74) *Attorney, Agent, or Firm* — Buchanan Ingersoll & Rooney PC

(57) ABSTRACT

A vehicle glazing comprising a glass substrate having an electrically conductive coating deposited on at least a portion of at least one surface thereof, wherein the electrically conductive coating comprises a pyrolytically deposited transparent conductive oxide layer, wherein a peripheral obscuration band printed on at least a portion of the electrically conductive coating, a cured electrically conductive ink printed on the peripheral obscuration band, and an electrically conductive element in electrical contact with both the electrically conductive coating and the cured electrically conductive ink. Also disclosed are a method of manufacturing a vehicle glazing and a vehicle comprising said vehicle glazing.

21 Claims, 4 Drawing Sheets

(58) Field of Classification Search
CPC . H05B 3/845; H05B 3/26; H05B 3/42; H05B 3/46; H05B 3/48; H05B 2203/02; H05B 2203/013; H05B 2203/008; H05B 2203/002; H05B 2203/031; H05B 1/0236; H05B 2214/02; B60H 1/2218; B60H 1/00742; B60H 1/00792; B60H 1/00971; B60H 1/2225; B60H 1/2215; B60H 2001/2293
See application file for complete search history.

(56) References Cited

U.S. PATENT DOCUMENTS

| | | | | |
|---|---|---|---|---|
| 4,654,067 | A | 3/1987 | Ramus et al. | |
| 5,099,104 | A | 3/1992 | Holzer et al. | |
| 5,099,105 | A * | 3/1992 | Goerenz | B32B 17/10036 219/203 |
| 5,299,726 | A | 4/1994 | Sauer | |
| 5,332,412 | A | 7/1994 | Manabe et al. | |
| 5,418,025 | A | 5/1995 | Harmand et al. | |
| 5,547,749 | A | 8/1996 | Chiba et al. | |
| 5,782,945 | A | 7/1998 | Gavin et al. | |
| 5,824,994 | A | 10/1998 | Noda et al. | |
| 5,968,637 | A | 10/1999 | Baret | |
| 10,645,761 | B2 * | 5/2020 | Schall | H05B 3/84 |
| 2001/0016253 | A1 | 8/2001 | Goda et al. | |
| 2004/0200821 | A1 * | 10/2004 | Voeltzel | C03C 17/3673 219/203 |
| 2007/0020465 | A1 | 1/2007 | Thiel et al. | |
| 2009/0053511 | A1 | 2/2009 | Kim et al. | |
| 2010/0243632 | A1 * | 9/2010 | Igura | H05B 3/84 219/203 |
| 2010/0270280 | A1 | 10/2010 | Blanchard et al. | |
| 2011/0108537 | A1 | 5/2011 | Schall | |
| 2012/0058311 | A1 | 3/2012 | Shimomura et al. | |
| 2014/0091073 | A1 | 4/2014 | Laurent et al. | |
| 2015/0351160 | A1 | 12/2015 | Phan et al. | |
| 2016/0174295 | A1 * | 6/2016 | Klein | H05B 3/84 219/203 |
| 2017/0034875 | A1 | 2/2017 | Weber et al. | |

FOREIGN PATENT DOCUMENTS

| | | | |
|---|---|---|---|
| EP | 1951001 | A1 | 7/2008 |
| EP | 2928264 | A1 | 10/2015 |
| EP | 3076753 | A1 | 10/2016 |
| WO | 2015162108 | A1 | 10/2015 |

OTHER PUBLICATIONS

International Search Report (PCT/ISA/210) dated Feb. 28, 2018, by the European Patent Office as the International Searching Authority for International Application No. PCT/GB2017/053123.
Written Opinion (PCT/ISA/237) dated Feb. 28, 2018, by the European Patent Office as the International Searching Authority for International Application No. PCT/GB2017/053123.

* cited by examiner

VEHICLE GLAZING

The present invention relates to vehicle glazings and to methods of manufacturing vehicle glazings.

Heater devices are well-known. For example, U.S. Pat. No. 3,931,496 discloses an electric heating means and in particular a multi-layer electrical film heater in strip form having an improved terminal means.

It is useful to produce vehicle glazings with a de-misting and/or a de-icing function by providing a means of electrically heating the vehicle glazing. To provide a vehicle glazing having an electrically heatable region the glass substrate may be provided, across the portion of the glazing to be heated, with thin wires (for example embedded in a laminated glazing) or printed tracks of electrically conductive ink to form a heating circuit. Heating circuits may, for example, be in the form of a grid.

Electrically heatable glazings may use an electrically conductive coating on a glass surface. US-A-2011/0108537 discloses a transparent pane with an electrically heatable coating extending over a major part of the surface area of the pane and which is electrically connected to at least two low impedance bus bars.

Heating circuits of electrically conductive tracks or wires generally have two or more busbars that are in electrical contact with the heating circuit and serve to connect the electrically conductive coating or wires to the power supply. Busbars may be formed of pre-formed conductive (e.g. metallic) tape or strip and/or may be formed using electrically conductive ink on the surface of the glass so as to be in electrical contact with the heating circuit. Electrically conductive ink used in vehicle glazings is usually based on silver, usually comprising silver particles in a glass frit. Silver containing inks are often screen printed and then thermally (i.e. fired) or UV cured for good robustness and adhesion to the glass surface.

In many vehicle glazings, for example, heated rear windows (backlights), the heating circuit is formed as a printed grid of thin heating elements and printed busbar(s) on the inner side of the glazing (i.e. inside the vehicle when installed) in order to protect the heating circuit from physical damage or weathering.

During curing (especially thermal curing) of the silver ink, silver can migrate into the glass surface.

Silver has been known for many years as a mobile species. For example, Michael Faraday investigated silver mobility after passing current through silver sulphide (Faraday, *Exptl. Res. Electy*. Vol. 1 p. 110, Fourth Series).

Migration of silver into a glass surface results in a noticeable colour change from a metallic grey to yellow/orange. This colour is not generally appealing to motor manufacturers or users. Although it is currently considered acceptable for printed heating elements to be yellow/orange, there is a need for the printed busbar to be invisible to the user when the vehicle glazing is installed. The busbar is usually, therefore, printed on a black obscuration band itself printed on the inside surface of the glass to ensure that the busbar is hidden from view from the outside of the vehicle.

There have been attempts to address the colour change problem.

DE-C-38 43 626 discloses a process for production of a laminated windscreen in which the inner pane has, on the interlayer side, a non-pyrolytic electro-conductive surface coating provided with lead supply tracks.

US 2012-A-058,311 discloses vehicle glazings produced using fired silver containing inks and discusses modification of the firing conditions to reduce silver ion diffusion into the glass surface and the noticeable colour change.

US-A-2001/0016253 discloses a glass substrate for display purposes comprising an alkali glass and a barrier layer of mainly indium oxide and/or tin oxide, an insulating film and an electrode film.

U.S. Pat. No. 5,332,412 discloses a process of forming a glass sheet by coating a portion of the glass sheet with a ceramic colour paste then forming a silver paste over a portion of the ceramic colour paste and firing the glass sheet. The ceramic colour paste is of a composition which prevents migration of silver ions into the glass plate and hence the adverse colour change.

U.S. Pat. No. 5,782,945 discloses a method of forming electrically conducting silver tracks on glass by applying a composition containing silver and boron to reduce silver ion migration.

U.S. Pat. No. 5,547,749 discloses a coloured ceramic composition that reduces silver migration into glass.

U.S. Pat. No. 5,968,637 discloses a glass substrate having a nitride based barrier interposed between the glass substrate and a silver based deposit to prevent yellowing by migration of silver into the glass.

US-A-2007/0020465 discloses a heatable transparency including a first ply having a No. 1 surface and a No. 2 surface and a second ply having a No. 3 surface and a No. 4 surface. The No. 2 surface faces the No. 3 surface. An electrically conductive coating is formed on at least a portion of the No. 2 or No. 3 surface.

U.S. Pat. No. 4,443,691 discloses an electrically heated window which achieves a more uniform current density at an interface between a resistive heating layer and the current-bearing electrodes to which it is connected. In one embodiment this is achieved by use of a high resistivity layer located between the electrode and the resistive heating layer.

It would however be advantageous to provide more effective methods to reduce or prevent the colour change of electrically conductive inks that are used in especially automotive glazings and overcome problems with the prior art.

It is an aim of the present invention to address such problems.

The present invention accordingly provides, in a first aspect, a vehicle glazing comprising, a glass substrate having an electrically conductive coating deposited on at least a portion of at least one surface thereof, wherein the electrically conductive coating comprises a pyrolytically deposited transparent conductive oxide layer, a peripheral obscuration band printed on at least a portion of the electrically conductive coating, a cured electrically conductive ink printed on the peripheral obscuration band, and an electrically conductive element in electrical contact with both the electrically conductive coating and the cured electrically conductive ink.

This is greatly advantageous because it allows the use of the electrically conductive pyrolytically deposited transparent conductive oxide layer as part of the heating circuit. Other advantages of the invention include that the electrically conductive ink retains its metallic colour which is more appealing to vehicle users and motor manufacturers. Furthermore, because the pyrolytic coating may itself be electrically conductive, the invention allows the use of the pyrolytically deposited transparent conductive oxide layer as a part of the heating circuit, reducing or removing the need for printed heating elements.

Surprisingly, the inventors have found that a pyrolytically deposited transparent conductive oxide layer serves as a heating element and as a barrier layer to prevent the colour change of electrically conductive inks that are printed on a peripheral obscuration band when combined with an electrically conductive element in electrical contact with both the layer and the electrically conductive ink.

In a first embodiment the electrically conductive element comprises at least a portion of the peripheral obscuration band wherein that portion is electrically conductive. The portion of the peripheral obscuration band obscures the cured electrically conductive ink and serves as an electrically conductive element.

In a second embodiment, where the peripheral obscuration band is not itself electrically conductive, the peripheral obscuration band comprises at least one aperture to allow electrical contact between the cured electrically conductive ink and the electrically conductive coating and an electrically conductive element comprises an electrically conductive fillet disposed in at least one aperture in the peripheral obscuration band.

The pyrolytically deposited transparent conductive oxide layer comprises an oxide (which may include an oxynitride or oxycarbide).

Although the invention addresses the colour change problem, it is nevertheless desirable that some or all of the printed busbar is obscured when the vehicle glazing is installed in the vehicle. Thus, the glazing comprises a peripheral obscuration band printed on at least a portion of the electrically conductive coating. This is advantageous because the obscuration band may be adapted to obscure the busbar and any connectors when the vehicle glazing is installed and in use.

The obscuration band, if provided, may be formed by printing (e.g. screen printing) a dark, usually black, band on the peripheral portion of the substrate over the electrically conductive coating. Dark is defined as of a suitable colour to partly or fully obscure under normal viewing conditions.

Usually, at least a portion of the cured electrically conductive ink is printed on the peripheral obscuration band. In order to ensure that the cured electrically conductive ink is in electrical contact with at least a portion of the electrically conductive coating, it may be advantageous, therefore, if at least a portion of the peripheral obscuration band is electrically conductive. This may be achieved by printing the peripheral obscuration band using an ink comprising pigment (preferably black or dark pigment, more preferably carbon for example carbon black), conductive particles (preferably silver, for example at 70 wt % to 90 wt % silver) and a matrix, preferably a frit, especially a glass frit. Thus, the electrically conductive element may comprise at least a portion of the peripheral obscuration band if that portion is electrically conductive.

Usually, substantially all of the cured electrically conductive ink will be printed on the peripheral obscuration band.

In order to ensure that the cured electrically conductive ink is in electrical contact with at least a portion of the electrically conductive coating, if the peripheral obscuration band is not itself electrically conductive, the peripheral obscuration band may comprise at least one aperture to allow electrical contact between the cured electrically conductive ink and the electrically conductive coating. Preferably, the peripheral obscuration band may comprise one, two, three, four, five six or more apertures. Since the printed busbars may be metallic in colour in accordance with the advantages of the invention, the apertures may be shaped so as to form patterns (e.g. of lines, dots, circles, squares, and/or other geometrical shapes) or indicia (for example product names, product identification, trade marks and/or logos) that are visible in the obscuration band from outside the vehicle when the glazing is installed.

Thus, the electrically conductive element may comprise at least one aperture in the peripheral obscuration band to allow electrical contact between the cured electrically conductive ink and the electrically conductive coating.

Where apertures are present, the electrically conductive element comprises an electrically conductive fillet disposed in at least one aperture in the peripheral obscuration band.

The printed busbar (or at least a part thereof) may be tinted a suitable, preferably a dark, colour. Printing a tinted busbar on a perforated obscuration band is advantageous in some applications because it may further obscure the apertures.

Thus, at least a portion of the cured electrically conductive ink may comprise an electrically conductive ink comprising pigment, preferably dark coloured pigment and more preferably black pigment. The electrically conductive element may comprise the dark coloured electrically conductive ink disposed in at least one aperture in the peripheral obscuration band which may form a dark electrically conductive fillet.

The electrically conductive element may comprise a first, dark coloured, electrically conductive ink disposed in at least one aperture in the peripheral obscuration band, and a second electrically conductive ink disposed so as to be in electrical contact with the first electrically conductive ink. The second electrically conductive ink may be non-tinted (i.e. silver coloured) and may be obscured by the peripheral obscuration band. This embodiment is advantageous because it allows the use of lower amounts of dark coloured electrically conductive ink which may be expensive.

Preferably, the electrically conductive ink comprises silver, usually silver particles and a frit. Usually, the electrically conductive ink comprises an average of 40 wt % to 90 wt % silver in the ink composition before curing, preferably 60 wt % to 85 wt % silver in the ink composition before curing, more preferably 70 wt % to 78 wt % silver in the ink composition before curing. Inks may have different silver content and may be mixed before printing to obtain a suitable silver content.

The electrically conductive ink is preferably thermally cured and/or UV (ultraviolet) cured.

Before curing it is usual for the ink to be heated to dry the ink (e.g. by infrared lamps) to reduce the chances of the ink smearing before or during curing.

Usually, the cured electrically conductive ink will have a sheet resistance in the range 0.01 Ω/square to 1 Ω/square, preferably 0.02 Ω/square to 0.7 Ω/square, more preferably 0.02 Ω/square to 0.5 Ω/square, most preferably 0.02 Ω/square to 0.2 Ω/square.

As discussed above, the use of a pyrolytically deposited coating that may, preferably, be deposited on a glass substrate by on-line coating is greatly advantageous in terms of process and product robustness especially compared to vacuum coatings, including sputtered coatings (e.g. of silver or metal oxides including ITO). Surprisingly, the pyrolytically deposited coating provides improvement in the colour change problem and may also, if electrically conductive, be used as part of the heating circuit, especially the heating element.

Useful pyrolytically deposited coatings include, in particular, chemical vapour deposited (CVD) coatings. Preferably, the coatings are of a CVD oxide, for example, silica, silicon oxycarbide, silicon oxynitride and/or a metal oxide, for example tin oxide.

If the pyrolytic coating comprises an insulating or substantially insulating material (for example, silica, silicon oxycarbide, silicon oxynitride) the thickness of the coating layer may be in the range 20 nm to 120 nm. Silica coatings may, for example, be 40 nm±10 nm in thickness, silicon oxycarbide and/or silicon oxynitride coatings may, for example, be 24 nm to 70 nm in thickness, preferably 55 nm to 63 nm in thickness.

Some metal oxides including doped tin oxide (for example fluorine doped tin oxide) and doped zinc oxide (for example aluminium doped zinc oxide) can form transparent conductive oxide coatings. Coatings with sheet resistance values less than about 1,500 to 1,000 Ω/square are generally considered to be conductive coatings. A coating of pure stoichiometric tin oxide on a glass substrate would generally have an extremely high sheet resistance. In some circumstances, tin oxide coatings may have a sheet resistance of about 350-400Ω per square due, at least partly, to oxygen deficiency in the tin oxide, rendering it conductive. Fluorine and other elements may be used as dopants in order to increase the conductivity of tin oxide.

The pyrolytically deposited transparent conductive oxide (TCO) may comprise tin oxide, doped tin oxide, doped zinc oxide or a mixture of two or more of these oxides. Other possible TCOs include undoped zinc oxide, alkali metal (potassium, sodium or lithium) stannates, zinc stannate, cadmium stannate or a mixture of two or more oxides. The preferred transparent conductive oxide comprises doped tin oxide, preferably fluorine doped tin oxide.

The pyrolytic transparent conductive oxide coating is preferably a CVD transparent conductive oxide coating, more preferably an atmospheric pressure CVD transparent conductive oxide coating. It is preferred if the pyrolytic transparent conductive oxide coating is an online deposited CVD transparent conductive oxide coating (i.e. deposited during the float glass production process when the float glass ribbon is at a temperature above 400° C.).

The pyrolytic transparent conductive oxide coating is preferably such that it was deposited on to the surface of glass substrate wherein the temperature of the glass was in the range of 450° C. to 725° C., preferably in the range of 550° C. to 700° C., more preferably in the range of 575° C. to 675° C. and most preferably in the range of 590° C. to 660° C.

Usually, the electrically conductive coating will comprise, in addition to the pyrolytically deposited transparent conductive oxide layer one or more further layers. The one or more further layers may include layers of silica, tin oxide (doped or undoped). The further layer(s) may be used in order to adjust the optical properties of the electrically conductive coating or to improve the growth and deposition of other layers of the coating. A most preferred embodiment of the electrically conductive coating comprises layers on a glass substrate in the order: glass/$SnO_2$/$SiO_2$/F-doped $SnO_2$.

It is preferred that the pyrolytically deposited transparent conductive oxide layer is the outermost layer of the electrically conductive coating. This is advantageous because it thereby improves the electrical contact with the electrically conductive ink.

Usually, the layer of a transparent conductive oxide will be such as to have a sheet resistance in the range 1 Ω/square to 120 Ω/square, preferably 1 Ω/square to 110 Ω/square, more preferably 5 Ω/square to 100 Ω/square, or 1 Ω/square to 50 Ω/square and most preferably 1 Ω/square to 40 Ω/square. Preferably, the sheet resistance of the layer of a transparent conductive oxide will be such as to have a sheet resistance in the range 3 Ω/square to 30 Ω/square, or in the range 5 Ω/square to 70 Ω/square, preferably 5 Ω/square to 50 Ω/square, more preferably 5 Ω/square to 30 Ω/square and most preferably 5 Ω/square to 25 Ω/square. The sheet resistance of TCO coatings (especially fluorine doped tin oxide coatings) may be modified by changing the thickness of the coating (generally a thicker coating has lower sheet resistance), changing the nature or amount of dopant, or by varying the temperature of the glass substrate during deposition.

Because of the preferred range of sheet resistance of the layer of a transparent conductive oxide, vehicle glazings according to the invention are preferably adapted to be installed in vehicles having power supplies at 10 V to 250 V, preferably 14 V to 250V and most preferably 24 V to 110 V.

Generally, the transparent conductive oxide coating will have an average surface roughness, Sa, (as determined according to ISO 25178, Sa being defined therein as the arithmetical mean height of the surface determined by AFM using a scan size of 5 μm×5 μm) in the range 5 to 40 nm, preferably 8 nm to 24 nm.

The thickness of the pyrolytically deposited transparent conductive oxide layer is usually in the range 50 nm to 500 nm, preferably 70 nm to 400 nm.

An advantage of the use of an electrically conductive coating and conductive ink is that the ink may form one or more busbars in the heating circuit. Thus, preferably, the cured electrically conductive ink in electrical contact with at least a portion of the electrically conductive coating forms at least a first busbar to electrically connect the electrically conductive coating to a power supply.

In a second aspect of the invention, there is provided a vehicle glazing comprising, a glass substrate having an electrically conductive coating comprising a pyrolytically deposited transparent conductive oxide layer, the coating being deposited on at least a portion of at least one surface of the glass substrate, a peripheral obscuration band printed on at least a portion of the electrically conductive coating, at least a first busbar comprising cured electrically conductive ink, the busbar being printed on the peripheral obscuration band, and an electrically conductive element in electrical contact with both the electrically conductive coating and first busbar.

The second (and other busbars) may be formed from pre-formed electrically conductive tape or strip (e.g. metal foil, preferably comprising copper, more preferably tinned copper), but may preferably also be printed. Thus, it is preferred that the vehicle glazing further comprises at least a second busbar comprising cured electrically conductive ink, the second busbar being printed on a second portion of the glazing so that it is in electrical contact with at least a second portion of the electrically conductive coating.

Usually the second busbar (and any other busbars, for example the third, fourth or fifth busbar) will also comprise cured electrically conductive ink, the second busbar being printed on the peripheral obscuration band, and having an electrically conductive element in electrical contact with both the electrically conductive coating and second busbar. The electrically conductive element and other features of the second busbar may generally be as described herein for the first busbar and/or the cured electrically conductive ink of the first aspect.

Preferably, the first and second busbars will be situated in the peripheral portions of different sides of the vehicle glazing with a predetermined distance between the first busbar and second busbar. The area formed by the length of the first busbar and second busbar and the distance between the first busbar and the second busbars forms the heatable area of the glazing.

It is preferred that the aspect ratio, that is the ratio of length of a relatively long side of the glazing to a relatively short side of the glazing, is in the range 1.1 to 4, preferably in the range 1.2 to 3.6 and more preferably in the range 1.4 to 3.4 (width to height).

Preferably, the first busbar and the second busbar extend along the relatively long sides of the glazing. This is advantageous because the distance between the first and second busbars is thereby relatively short, enabling good de-misting or de-icing properties even if the sheet resistance of the pyrolytically deposited conductive oxide coating is relatively high.

The vehicle glazing according to the invention may be generally flat or curved.

The heatable area of the vehicle glazing according to the invention is preferably relatively large and will generally be at least 50%, preferably at least 60%, more preferably at least 70% even more preferably at least 80%, and most preferably at least 90% of the area of the vehicle glazing.

In a third aspect, the present invention provides a method of manufacturing a vehicle glazing, the method comprising, a) providing a first glass ply coated with an electrically conductive coating comprising a pyrolytically deposited transparent conductive oxide layer, the coating being deposited on at least a portion of at least one surface of the glass substrate, b) printing a peripheral obscuration band on a peripheral portion of substrate, c) printing at least one busbar using an electrically conductive ink so that it is in electrical contact with an electrically conductive element in electrical contact with the electrically conductive coating, d) curing the electrically conductive ink.

In a fourth aspect, the present invention provides a method of manufacturing a vehicle glazing, the method comprising a) providing a first glass ply coated with an electrically conductive coating comprising a pyrolytically deposited transparent conductive oxide layer, the coating being deposited on at least a portion of at least one surface of the glass substrate, b) printing a peripheral obscuration band containing at least one aperture on a peripheral portion of substrate, c) printing at least one busbar on the peripheral obscuration band using an electrically conductive ink so that it covers the aperture thereby providing electrical contact between the busbar and the electrically conductive coating, d) curing the electrically conductive ink.

The present invention will now be described by way of example only, and with reference to, the accompanying drawings, in which.

Figure 1:
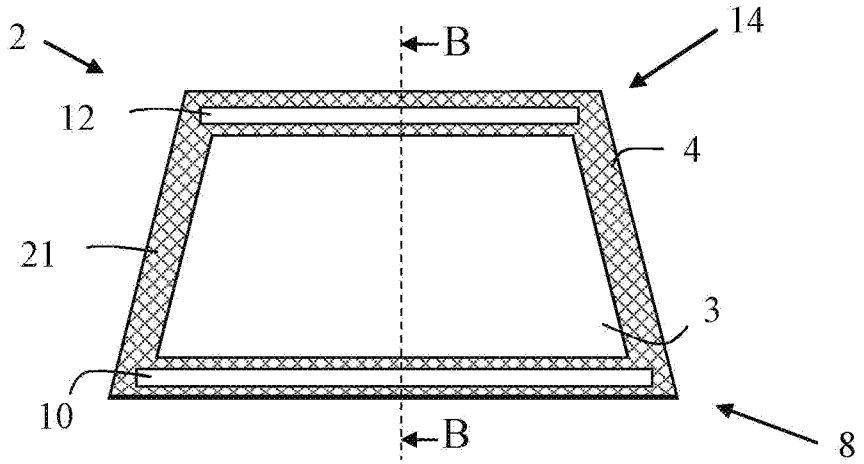
FIG. 1 is a schematic plan view of the inner surface of a vehicle glazing according to the invention having a printed peripheral obscuration band.
Figure 2:
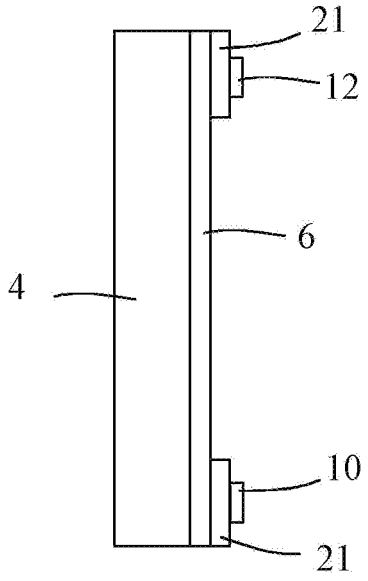
FIG. 2 is a schematic cross sectional view through the vehicle glazing of FIG. 1 on B-B.

FIG. 1 and FIG. 2 show respectively a plan view and a cross-sectional view of a vehicle glazing 2 suitable for use as a vehicle rear window. FIG. 1 is the plan view of the surface of the vehicle glazing 2 that would be inside the vehicle when installed and in use. The vehicle glazing 2 comprises float glass substrate 4 having pyrolytically deposited electrically conductive coating 6 comprising a layer of $F:SnO_2$ on the air side surface thereof. An electrically conductive peripheral obscuration band 21 is screen printed using an ink (Chimet 3900) comprising silver (70 to 78 wt %) and carbon black in a frit on the electrically conductive coating 6 around the periphery of the glazing 2, framing the viewable area 3 of the glazing. In the lower peripheral part 8 of the vehicle glazing 2 there is a lower busbar 10 screen printed on the electrically conductive peripheral obscuration band 21. The lower busbar 10 is printed using an ink containing 70 to 78 wt % silver particles in a glass frit and subsequently thermally cured. An upper busbar 12 in the upper peripheral part 14 of the vehicle glazing 2 is screen printed in the same way. The electrically conductive coating 6 prevents the usual colour change and the lower busbar 10 and upper busbar 12 are therefore a metallic colour. The peripheral obscuration band 21 serves to obscure the upper busbar 12 and lower busbar 10 from view outside the vehicle when the glazing 2 is installed. Because the peripheral obscuration band 21 is electrically conductive, the electrically conductive coating 6 and upper busbar 12 and lower busbar 10 are in electrical contact.

The peripheral obscuration band may comprise a plurality of apertures (e.g. defined portions of the peripheral obscuration band 21 that are not printed). This would be particularly advantageous if, as an alternative to the embodiment of FIGS. 1 and 2, the peripheral obscuration band was not electrically conductive (e.g. by printing using an ink comprising carbon black in a frit but with little or no silver) because it would still allow electrical contact between the busbars 10, 12 and the electrically conductive coating 6.

Figure 3:
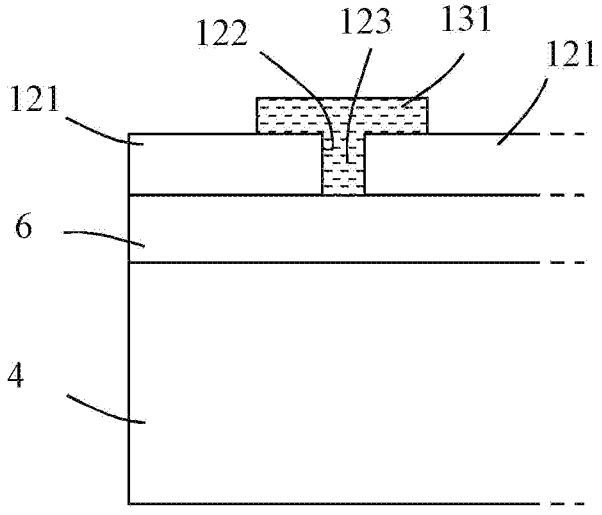
FIG. 3 is a schematic cross sectional view through a lower portion of the edge of a second vehicle glazing.

FIG. 3 shows a schematic cross section of a portion of the edge of the lower portion of a vehicle glazing according to the invention. The vehicle glazing is generally similar to the embodiment illustrated in FIGS. 1 and 2 with a peripheral obscuration band 121. Thus, the vehicle glazing comprises a float glass substrate 4 having pyrolytically deposited electrically conductive coating 6 comprising a layer of $F:SnO_2$. There is a lower busbar 131 screen printed on the peripheral obscuration band 121 itself screen printed using an ink comprising carbon black in a frit on the electrically conductive coating 6. The material of the peripheral obscuration band 121 is not electrically conductive but there are one or more apertures 122 so that the ink forming the busbar 131 flows into the aperture 122 forming an electrically conductive fillet 123 that makes electrical contact with the electrically conductive coating 6. Busbar 131 is printed using an ink containing 50 to 78 wt % silver particles in a glass frit. The ink of the busbar 131 is subsequently thermally cured. The electrically conductive coating 6 prevents the usual colour change and the busbar 131 is therefore a metallic colour. The peripheral obscuration band 121 serves to obscure much of the busbar 131, but the fillet 123 in the aperture 122 would be visible from outside the vehicle as a metallic shape when the glazing is installed.

Figure 4:
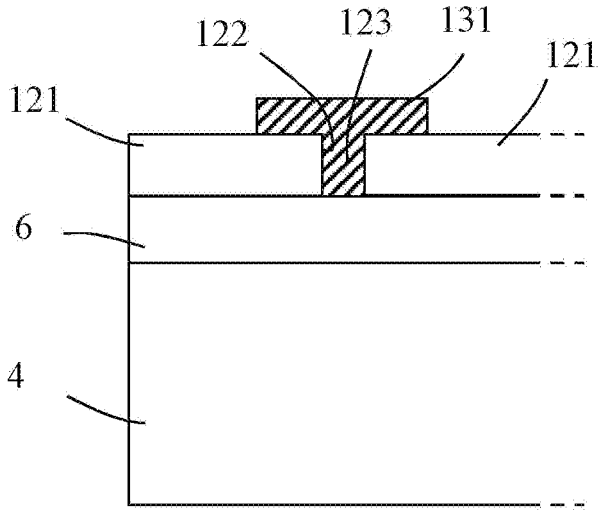
FIG. 4 is a schematic cross sectional view through a lower portion of the edge of a third vehicle glazing.

FIG. 4 shows a schematic cross section of a lower portion of the edge of a third vehicle glazing according to the invention. The vehicle glazing is generally similar to the embodiment illustrated in FIG. 3, but in this case busbar 131 is printed using an ink containing 50 to 78 wt % silver particles and carbon black pigment in a glass frit. The ink of the busbar 131 is subsequently thermally cured. The ink forming the busbar 131 flows into the aperture 122 during printing forming a conductive fillet 123 that makes electrical contact with the electrically conductive coating 6. Although, the electrically conductive coating 6 prevents the usual colour change, the busbar 131 is dark in colour so that the fillet 123 in the aperture 122 is less visible (and may closely match in colour the peripheral obscuration band 121) from outside the vehicle when the glazing is installed.

Figure 5:
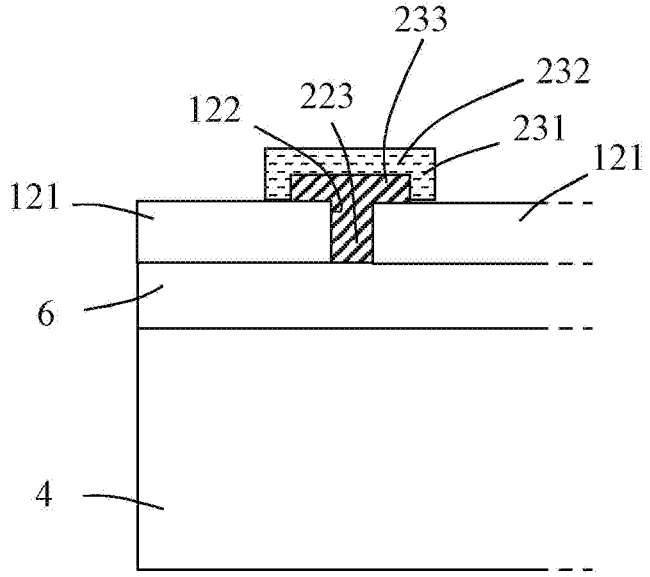
FIG. 5 is a schematic cross sectional view through a lower portion of the edge of a fourth vehicle glazing.

FIG. 5 shows a schematic cross section of a lower portion of the edge of a fourth vehicle rear window according to the invention. The vehicle rear window is generally similar to the embodiment illustrated in FIG. 3, with a peripheral obscuration band 121 having one or more apertures 122. The busbar 231 is formed of a first conductive ink 233 which is printed first and flows into the apertures 122 forming a conductive fillet 223 and making electrical contact with the electrically conductive coating 6. A second conductive ink 232 is overprinted on the first conductive ink 233. The first conductive ink 233 contains 50 to 78 wt % silver particles in a glass frit with carbon black pigment. The second conductive ink forming 232 comprises 50 to 78 wt % silver particles in a glass frit. The inks of the busbar 231 are subsequently thermally cured. The peripheral obscuration band 121 serves to obscure much of the busbar 231, the conductive fillet 223 in the aperture 122 formed from dark first conductive ink 233 would be less or not visible from outside the vehicle as a dark colour against the dark peripheral obscuration band 121 when the glazing is installed.

Figure 6:
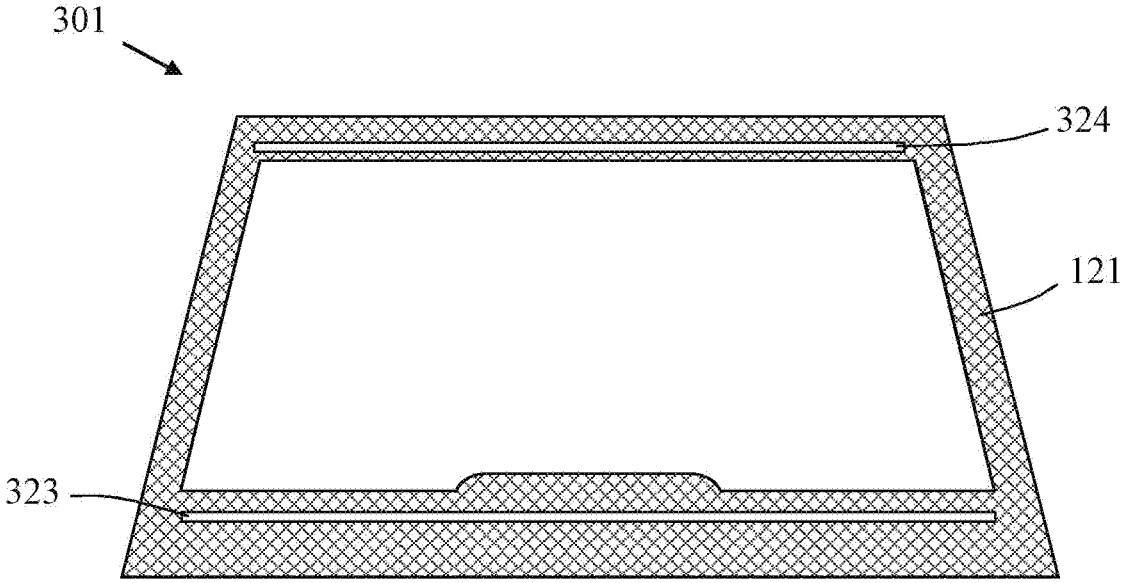
FIG. 6 is a schematic plan view of the outer surface of a fifth vehicle glazing.

FIG. 6 is a schematic plan view of the outer surface (i.e. the surface that would be visible from outside the vehicle when the window is installed in a vehicle) of a fifth vehicle glazing 301 suitable for use as a rear vehicle window. The lower part of the vehicle glazing 301 in cross section is generally as shown in FIG. 3 and the parts of the glazing 301 illustrated there will not be described in detail. The peripheral obscuration band 121 has an upper aperture 324 and lower aperture 323 each in the form of a thin line. The upper and lower busbars are printed using an ink containing 50 to 78 wt % silver particles in a glass frit. After printing, the ink of the busbar is thermally cured. The electrically conductive coating (see FIG. 3) prevents the usual colour change and the upper and lower busbars are therefore a metallic colour. The peripheral obscuration band 121 serves to obscure most of each busbar, but the fillets making electrical connection to the electrically conductive coating are visible through the upper aperture 324 and lower aperture 323 as thin metallic appearing lines on the outside surface.

Figure 7:
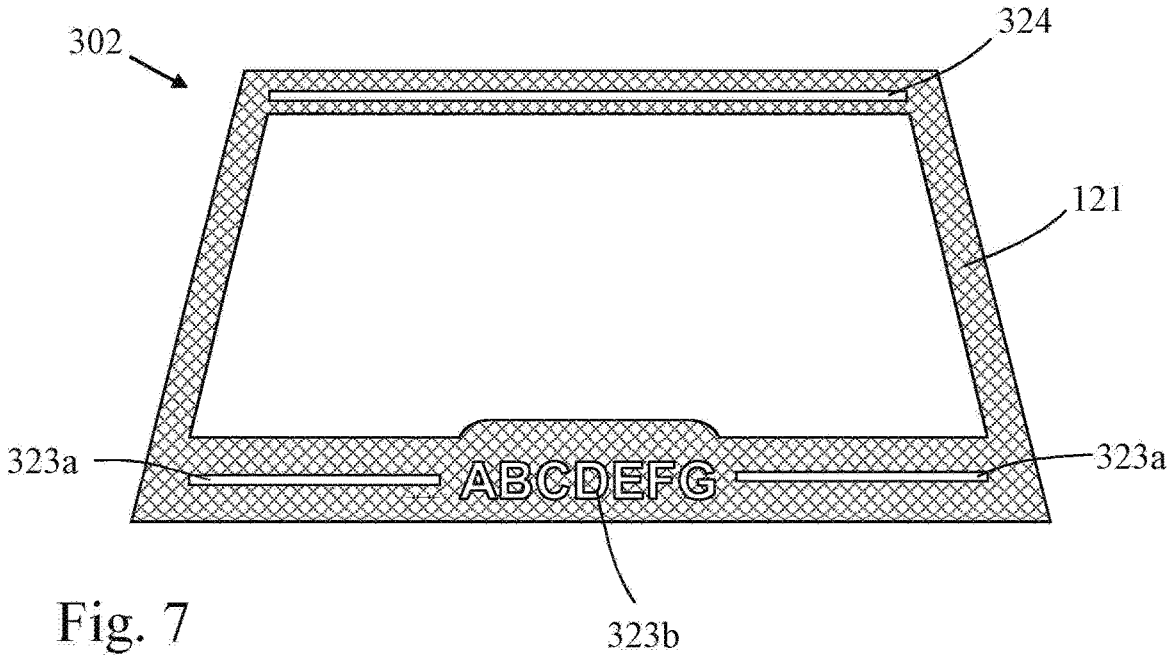
FIG. 7 is a schematic plan view of the outer surface of a sixth vehicle glazing.

FIG. 7 is a schematic plan view of the outer surface (i.e. the surface that would be visible from outside the vehicle when the window is installed in a vehicle) of a sixth vehicle glazing 302 suitable for use as a rear vehicle window. The vehicle glazing 302 is generally similar is that illustrated in FIG. 6, but the lower apertures are in the form of lines 323*a* and indicia 323*b* and so the fillets making electrical connection to the electrically conductive coating are visible through the lower apertures as lines (323*a*) and indicia (323*b*). In FIG. 7, the indicia apertures 323*b* are letters, but in other embodiments the indicia apertures 323*b* may be shaped to indicate logos, designs, names, product identifiers or similar indicators.

Figure 8:
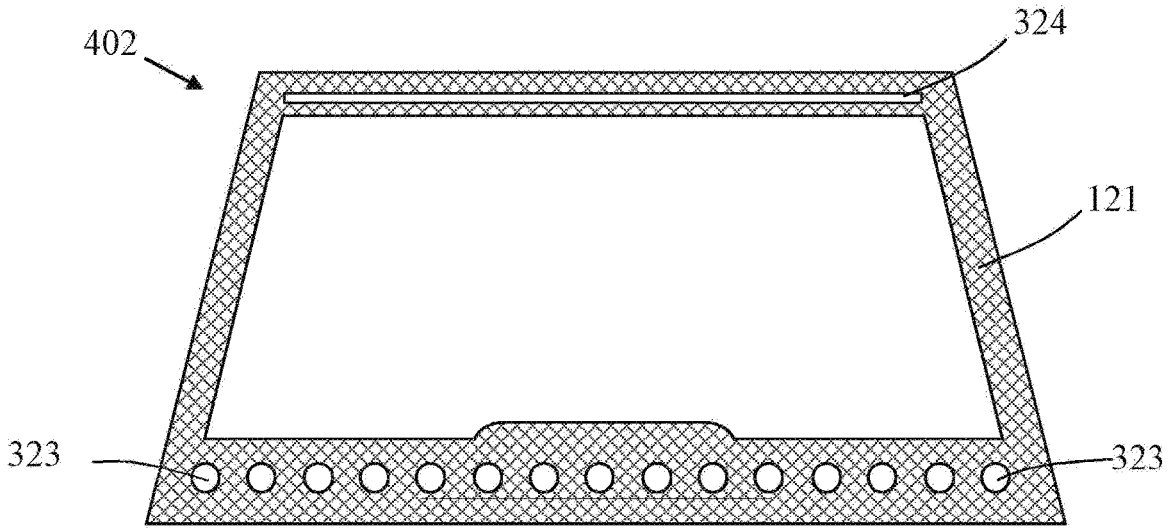
FIG. 8 is a schematic plan view of the outer surface of a seventh vehicle glazing.

FIG. 8 is a schematic plan view of the outer surface (i.e. the surface that would be visible from outside the vehicle when the window is installed in a vehicle) of a seventh vehicle glazing 402 suitable for use as a rear vehicle window. The vehicle glazing 402 is generally similar is that illustrated in FIGS. 6 and 7, but the lower apertures are in the form of circular apertures 323 and so the fillets making electrical connection to the electrically conductive coating are visible through the lower apertures 323 as circles. In FIG. 8, the lower apertures 323 are circles, but in other embodiments the upper 324 and/or lower apertures 323 may be generally any suitable shape (e.g. square, rectangle, oval, star, triangle, diamond, pentagon, hexagon, etc).

The present invention will now be further illustrated by the Examples in which samples of vehicle glazings consisting of a glass substrate coated with an electrically conductive layers of fluorine doped tin oxide were printed with silver containing conductive ink and cured.

EXAMPLES

Electrical Properties

The sheet resistance of the Examples was determined using a surface resistivity meter with a 4-point probe (Guardian Model SRM 232). Measurements were taken at the same thickness for each sample, and the mean of three measurements was taken.

Substrates

In the Examples, the coated glass plies were of float glass coated with fluorine doped tin oxide (as the outer layer).

The coated glass plies were of the form glass/undoped $SnO_2/SiO_2$/F doped $SnO_2$ with the doped tin oxide layer to product a coated glass ply having a sheet resistance of 15 Ω/square. By varying the thickness of the doped tin oxide coating the sheet resistance may also be varied.

The fluorine-doped tin dioxide layer was deposited using on-line CVD coating. This is done during the float glass production process with the temperature of the glass substrate at 600 to 650° C. A tin-containing precursor, in the form of dimethyltin dichloride (DMT), is heated to 177° C. and a stream of carrier gas, in the form of helium, is passed through the DMT. Gaseous oxygen is subsequently added to the DMT/helium gas stream. At the same time, a fluorine-containing precursor, in the form of anhydrous hydrogen fluoride (HF), is heated to 204° C. Additional water is added to create a mixture of gaseous HF and water. The two gas streams are mixed and delivered to the hot glass surface at a rate of around 395 litres/minute. The ratio of DMT to oxygen to HF is 3.6:61.3:1. The thickness of the resulting fluorine-doped tin oxide layer is approximately 320 nm and it has a nominal sheet resistance of about 15 Ω/square, measured as 12 to 13 Ω/square.

EXAMPLES

Washed pyrolytically coated glasses as described above (of measured sheet resistance 12 to 13 Ω/square) were used as the substrate. Silver busbars were screen printed (using Chimet AG 3900 ink having a nominal silver content of 80 wt %) on the upper and lower peripheral portions of the rear window on the pyrolytic electrically conductive coating.

After firing/curing at 680° C., cycle time 100 seconds, the printed busbars were metallic silver in colour. Busbars printed in the same way on glass substrates without the pyrolytic coating were orange after firing/curing.

On the inventive samples, the metallic silver remained the same after firing and over time (more than 12 months).

Samples were also produced applying printed silver busbars to the pyrolytic electrically conductive coated surface.

Over 6 months, silver print remained metallic in colour. Samples were also produced by printing the substrates (using standard black ink obtained from Johnson Matthey) with obscuration bands having apertures in the form of lines. Silver busbars were screen printed (using Chimet AG 3900 ink having a nominal silver content of 80 wt %) on the peripheral obscuration bands. After firing/curing at 680° C. cycle time 100 seconds, the printed busbars were metallic silver in colour and parts of the metallic busbars were visible through the apertures in the obscuration bands.

REFERENCE NUMERALS

2 Vehicle glazing
3 Viewable area
4 Float glass substrate
6 Electrically conductive coating
8 Lower peripheral part
10 Lower busbar
12 Upper busbar
14 Upper peripheral part
21 Electrically conductive peripheral obscuration band
121 Peripheral obscuration band
122 Aperture
123 Electrically conductive fillet
131 Lower busbar
223 Electrically conductive fillet
231 Lower busbar
232 Second conductive ink
233 First conductive ink
301 Vehicle glazing
302 Vehicle glazing
323 Lower Aperture
323*a* Lower line aperture
323*b* Lower indicia aperture
324 Upper aperture
402 Vehicle glazing

The invention claimed is:

1. A vehicle glazing comprising:

a glass substrate having an electrically conductive coating deposited on at least a portion of at least one surface thereof, wherein the electrically conductive coating comprises a pyrolytically deposited transparent conductive oxide layer, a peripheral obscuration band printed on at least a portion of the electrically conductive coating, a cured electrically conductive ink printed on the peripheral obscuration band, and an electrically conductive element in electrical contact with both the electrically conductive coating and the cured electrically conductive ink, wherein the electrically conductive element comprises at least one aperture in the peripheral obscuration band to allow electrical contact between the cured electrically conductive ink and the electrically conductive coating.

2. A vehicle glazing as claimed in claim 1, wherein substantially all of the cured electrically conductive ink is printed on the peripheral obscuration band.

3. A vehicle glazing as claimed in either claim 1, wherein the electrically conductive element comprises an electrically conductive part of the peripheral obscuration band.

4. A vehicle glazing as claimed in claim 1, wherein the electrically conductive element comprises an electrically conductive fillet disposed in at least one aperture in the peripheral obscuration band.

5. A vehicle glazing as claimed in claim 1, wherein the electrically conductive ink comprises silver.

6. A vehicle glazing as claimed in claim 5, wherein the electrically conductive ink comprises an average of 40 wt % to 90 wt % silver in the ink composition before curing.

7. A vehicle glazing as claimed in claim 1, wherein the cured electrically conductive ink comprises an electrically conductive ink comprising pigment.

8. A vehicle glazing as claimed in claim 7, wherein the electrically conductive element comprises an electrically conductive fillet formed of dark electrically conductive ink disposed in at least one aperture in the peripheral obscuration band.

9. A vehicle glazing as claimed in claim 8, further comprising a second electrically conductive ink disposed so as to be in electrical contact with the first electrically conductive ink.

10. A vehicle glazing as claimed in claim 1, wherein the electrically conductive ink is thermally cured and/or is UV cured.

11. A vehicle glazing as claimed in claim 1, wherein the cured electrically conductive ink has a sheet resistance in the range 0.01 Ω/square to 1 Ω/square.

12. A vehicle glazing as claimed in claim 1, wherein the pyrolytically deposited transparent conductive oxide comprises doped tin oxide, doped zinc oxide, a stannate or a mixture of two or more of these oxides.

13. A vehicle glazing as claimed in claim 12, wherein the pyrolytically deposited transparent conductive oxide comprises tin oxide.

14. A vehicle glazing as claimed in claim 1, wherein the thickness of the pyrolytically deposited layer is in the range 50 nm to 500 nm.

15. A vehicle glazing as claimed in claim 1, wherein the electrically conductive coating has a sheet resistance in the range 5 Ω/square to 100 Ω/square.

16. A vehicle glazing as claimed in claim 1, wherein the pyrolytically deposited transparent conductive oxide layer is the outermost layer of the electrically conductive coating.

17. A vehicle glazing as claimed in claim 1, wherein the cured electrically conductive ink forms a first busbar to electrically connect the electrically conductive coating to a power supply.

18. A vehicle glazing comprising, a glass substrate having an electrically conductive coating comprising a pyrolytically deposited transparent conductive oxide layer, the coating being deposited on at least a portion of at least one surface of the glass substrate, a peripheral obscuration band printed on at least a portion of the electrically conductive coating, at least a first busbar comprising cured electrically conductive ink, the busbar being printed on the peripheral obscuration band, and an electrically conductive element in electrical contact with both the electrically conductive coating and first busbar, wherein the electrically conductive element comprises at least one aperture in the peripheral obscuration band to allow electrical contact between the cured electrically conductive ink and the electrically conductive coating.

19. A vehicle glazing as claimed in claim 17, further comprising at least a second busbar comprising cured electrically conductive ink, the second busbar being printed on a second portion of the glazing so that it is in electrical contact with at least a second portion of the electrically conductive coating.

20. A method of manufacturing a vehicle glazing, the method comprising a) providing a first glass ply coated with an electrically conductive coating comprising a pyrolytically deposited transparent conductive oxide layer, the coating being deposited on at least a portion of at least one surface of the glass substrate, b) printing a peripheral obscuration band containing at least one aperture on a peripheral portion of substrate, c) printing at least one busbar on the peripheral obscuration band using an electrically conductive ink so that it covers the aperture thereby providing electrical contact between the busbar and the electrically conductive coating, and d) curing the electrically conductive ink.

21. A vehicle having a power supply at 10 V to 250 V and comprising a vehicle glazing as claimed in claim 1.

* * * * *